US008236151B1

(12) United States Patent
Olson et al.

(10) Patent No.: US 8,236,151 B1
(45) Date of Patent: Aug. 7, 2012

(54) SUBSTRATE CARRIER FOR WET CHEMICAL PROCESSING

(75) Inventors: Timothy L. Olson, Phoenix, AZ (US); Kenneth Charles Blaisdell, Gilbert, AZ (US); William Walter Charles Koutny, Jr., Santa Clara, CA (US)

(73) Assignee: Cypress Semiconductor Corporation, San Jose, CA (US)

( * ) Notice: Subject to any disclaimer, the term of this patent is extended or adjusted under 35 U.S.C. 154(b) by 156 days.

(21) Appl. No.: 12/851,403

(22) Filed: Aug. 5, 2010

Related U.S. Application Data

(60) Provisional application No. 61/256,308, filed on Oct. 30, 2009.

(51) Int. Cl.

| | |
|---|---|
| ***C25B 9/02*** | (2006.01) |
| ***C25D 17/06*** | (2006.01) |
| ***C25D 17/08*** | (2006.01) |
| ***C23C 14/50*** | (2006.01) |

(52) U.S. Cl. ..... 204/297.06; 204/297.01; 204/297.07; 204/297.09; 204/286.1; 204/298.15

(58) Field of Classification Search ..... 204/297.01, 204/297.06, 297.07, 297.09, 286.1, 298.11, 204/298.15; 118/500, 504, 505; 269/37, 269/43, 287

See application file for complete search history.

(56) References Cited

U.S. PATENT DOCUMENTS

| | | | | |
|---|---|---|---|---|
| 6,844,274 | B2 * | 1/2005 | Yoshioka et al. | 438/800 |
| 7,022,211 | B2 * | 4/2006 | Yoshioka et al. | 204/297.01 |
| 7,445,697 | B2 * | 11/2008 | Keigler et al. | 204/297.01 |
| 7,897,024 | B2 * | 3/2011 | Yahagi et al. | 204/279 |
| 7,901,551 | B2 * | 3/2011 | Yoshioka et al. | 204/297.1 |
| 2009/0245983 | A1 * | 10/2009 | Law et al. | 414/226.04 |

* cited by examiner

*Primary Examiner* — Bruce Bell

(57) ABSTRACT

A carrier provides the ability to perform wet chemical processing on substrates using low cost equipment inspired by the electroplating methods typically utilized in leadframe-based semiconductor packaging or printed circuit board industries. Two frame pieces are mated together to form the carrier which enables transport of at least one substrate through wet chemical processing and includes a non-conductive frame with an exposed conductive flange to allow electrical coupling with processing equipment. Electrical contacts within the non-conductive frame make contact with the at least one substrate and are coupled to the conductive flange allowing an electrical potential to develop across the substrate while undergoing processing within the electroplating equipment.

19 Claims, 4 Drawing Sheets

SECTION A-A

SUBSTRATE CARRIER FOR WET CHEMICAL PROCESSING

RELATED APPLICATIONS

This application claims the benefit of U.S. Provisional Application No. 61/256,308 filed on Oct. 30, 2009.

TECHNICAL FIELD

This disclosure relates to the field of semiconductor device manufacturing and, in particular, to a carrier for use in wet chemical processing of a substrate.

BACKGROUND

Integrated circuits are formed through a process known as semiconductor device fabrication. The semiconductor device may be formed on a thin slice, or wafer, of semiconductor material, such as silicon crystal. The wafer serves as a substrate for microelectronic devices built on the wafer. During fabrication of these integrated circuits, the silicon wafer is put through a sequence of wet chemical processing steps. One wet chemical processing step in the sequence is electrochemical deposition, commonly known as electroplating.

In the electroplating process, electrical current is used to deposit metal ions from a solution onto a wafer, forming a film or patterned structure of metal on the wafer. Certain semiconductor packaging technologies, such as Wafer Level Chip Scale Packaging and Flip Chip, involve multiple electroplating steps. Many electroplating processes make use of semiconductor fabrication plant (fab) equipment. The fab equipment is designed to plate a single wafer at a time causing the electroplating process to be slow. The fab equipment is also typically very expensive. In addition, downtime is common due to high maintenance requirements and plating chemistries are expensive due to the small quantities used. These factors result in a high cost per wafer to perform electroplating.

Plating equipment used in other industries, including batch and continuous processing systems used in traditional semiconductor packaging are considerably less expensive and more efficient than the fab equipment. This plating equipment may include that used for printed circuit boards or leadframe plating lines. Such plating equipment provides typical throughputs which are approximately ten times greater than that of fab equipment at a cost that is typically half that of the fab equipment. Currently, however, there is no way to electroplate semiconductor wafers using printed circuit board or leadframe style plating equipment.

BRIEF DESCRIPTION OF THE DRAWINGS

The present disclosure is illustrated by way of example, and not by way of limitation, in the figures of the accompanying drawings.

DETAILED DESCRIPTION

The following description sets forth numerous specific details such as examples of specific systems, components, methods, and so forth, in order to provide a good understanding of several embodiments of the present invention. It will be apparent to one skilled in the art, however, that at least some embodiments of the present invention may be practiced without these specific details. In other instances, well-known components or methods are not described in detail or are presented in simple block diagram format in order to avoid unnecessarily obscuring the present invention. Thus, the specific details set forth are merely exemplary. Particular implementations may vary from these exemplary details and still be contemplated to be within the scope of the present invention.

Embodiments of an apparatus are described for a carrier that provides the ability to perform wet chemical processing on a substrate using low cost, printed circuit board or leadframe style plating equipment. The carrier allows the substrate to be suspended from a machine transport mechanism as the substrate is moved through the electroplating machine. In one embodiment, the carrier includes a conductive flange which couples the carrier to the machine transport mechanism of the plating equipment. A non-conductive frame formed from two frame pieces is coupled to the conductive flange and holds at least one substrate in place during electroplating. The frame can hold two device substrates or one device and one dummy structure if required to handle uneven batch sizes. Depending on the embodiment, the substrate held in the carrier may be any of a number of different substrate types. For example, the substrate may be a crystalline substrate, such as a semiconductor wafer, a composite material such as a laminate substrate or molded structure, a flex circuit or polymer based structure, a metallic substrate, or other type of substrate. As an example, further description herein will be in terms of a wafer and the carrier may be referred to as a wafer carrier, however, this description shall not be construed as limiting in any way. Electrical contact is coupled to the conductive flange enabling a plating electrical circuit to be selectively established when the carrier is suspended by the machine transport mechanism in a wet bath during processing.

Figure 1:
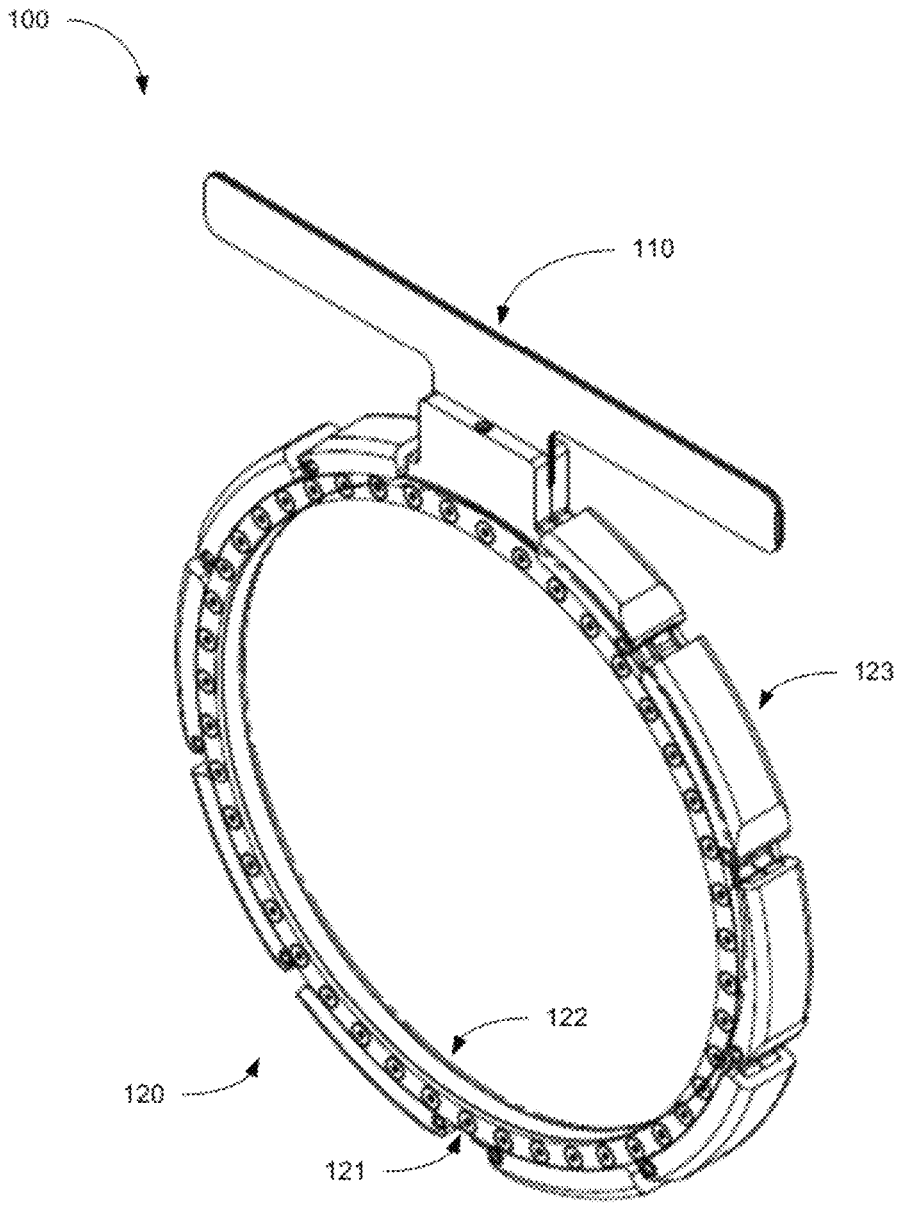
FIG. 1 is a diagram illustrating a carrier according to an embodiment.

FIG. 1 is a diagram illustrating a wafer carrier 100 according to an embodiment of the present invention. The wafer carrier 100 includes a conductive flange 110 which couples the wafer carrier 100 to a machine transport mechanism within a plating machine (not shown). In one embodiment, the processing equipment may include an in-line plating machine. The in-line plating machine may be similar to equipment used in leadframe strip plating lines. Leadframe strip plating lines are well established in the packaging industry and may generally suspend and traverse conductive copper leadframes on a metal belt through a sequence of steps in the plating process. In another embodiment, the wafer carrier may be used with rack style plating equipment such as that used in electroplating of printed circuit boards. In other embodiments, some other transport mechanism may be used.

Conductive flange 110 attaches to the transport mechanism of the plating equipment and allows the wafer carrier 100 to be advanced through the plating machine. In one embodiment conductive flange 110 is formed from stainless steel, although in other embodiments, conductive flange 110 may be formed from any conductive material, such as for example, copper, another metal, or a non-metal conductive material. In one embodiment, conductive flange 110 is thin enough to afford it some degree flexibility. In certain in-line plating machines, the belt is curved around drums as the belt changes direction. The conductive flange 110, when attached to the belt, may also curve around the drums. In one embodiment, conductive flange 110 may be flexible enough to bend in an arc having a radius of approximately 24 inches.

Wafer carrier 100 also includes non-conductive frame 120. Non-conductive frame 120 is coupled to conductive flange 110 so that non-conductive frame 120 is able to be suspended from the machine transport mechanism of the plating machine. In one embodiment, non-conductive frame 120 is formed from a ring of non-conductive material, such as for example chlorinated polyvinyl chloride (CPVC). In other embodiments, other non-conductive materials may be used. Non-conductive frame 120 may be formed into a ring of non-conductive material having an inside diameter slightly smaller than the diameter of the wafer to be electroplated. For example, non-conductive frame 120 may be sized appropriately to hold a 200 millimeter (mm) or a 300 mm silicon wafer. In other embodiments, non-conductive frame 120 may be sized to hold a wafer having some other size.

In one embodiment, non-conductive frame 120 may be formed from two separate frame pieces 121 and 122. Frame pieces 121 and 122 may be identical or substantially identical having one or more built-in clamps 123 to hold the pieces 121 and 122 together. In one embodiment, each frame piece is identical and includes half of the total number of clamps. In other embodiments, the clamps 123 may all be included on one frame piece or arranged between the two frame pieces in some other proportion. In one embodiment, each frame piece 121 and 122 holds a wafer and the frame pieces 121 and 122 are secured together with the wafers being oriented parallel to one another and held together by clamps 123 to form non-conductive frame 120. The frame pieces 121 and 122 may be oriented so that the wafers are back-to-back, with the front side of each wafer facing out. Optionally, a spacer may be placed in between the two wafers within the frame assembly to provide a compliant layer.

Figure 2:
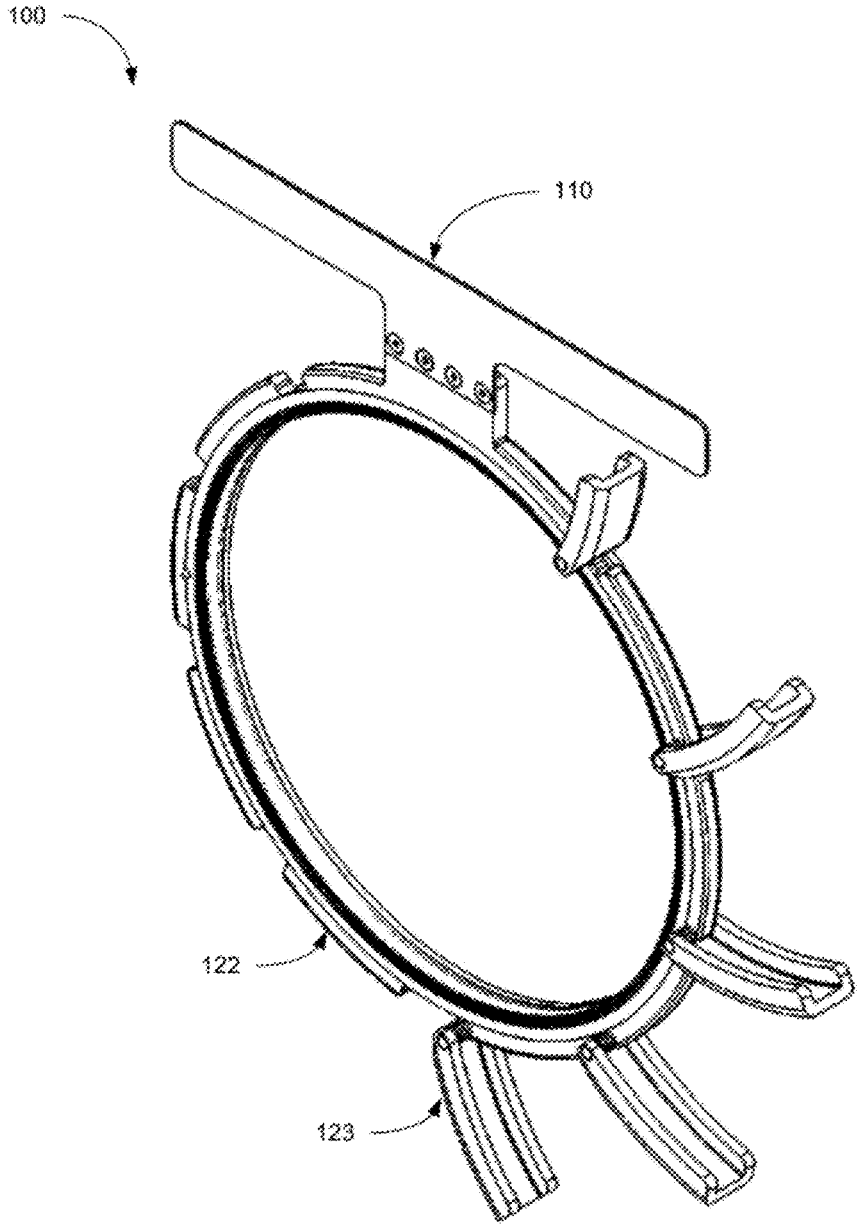
FIG. 2 is a diagram illustrating a carrier according to an embodiment.

FIG. 2 is a diagram illustrating a wafer carrier 100 according to an embodiment of the present invention. In this embodiment clamps 123 are open and frame piece 121 has been removed. Remaining is frame piece 122. A wafer may be placed into frame piece 122 which can be secured together with frame piece 121 by clamps 123. Clamps 123 may also be formed from CPVC or other non-conductive material or material which is not subject to build-up or reduction during processing.

Figure 3:
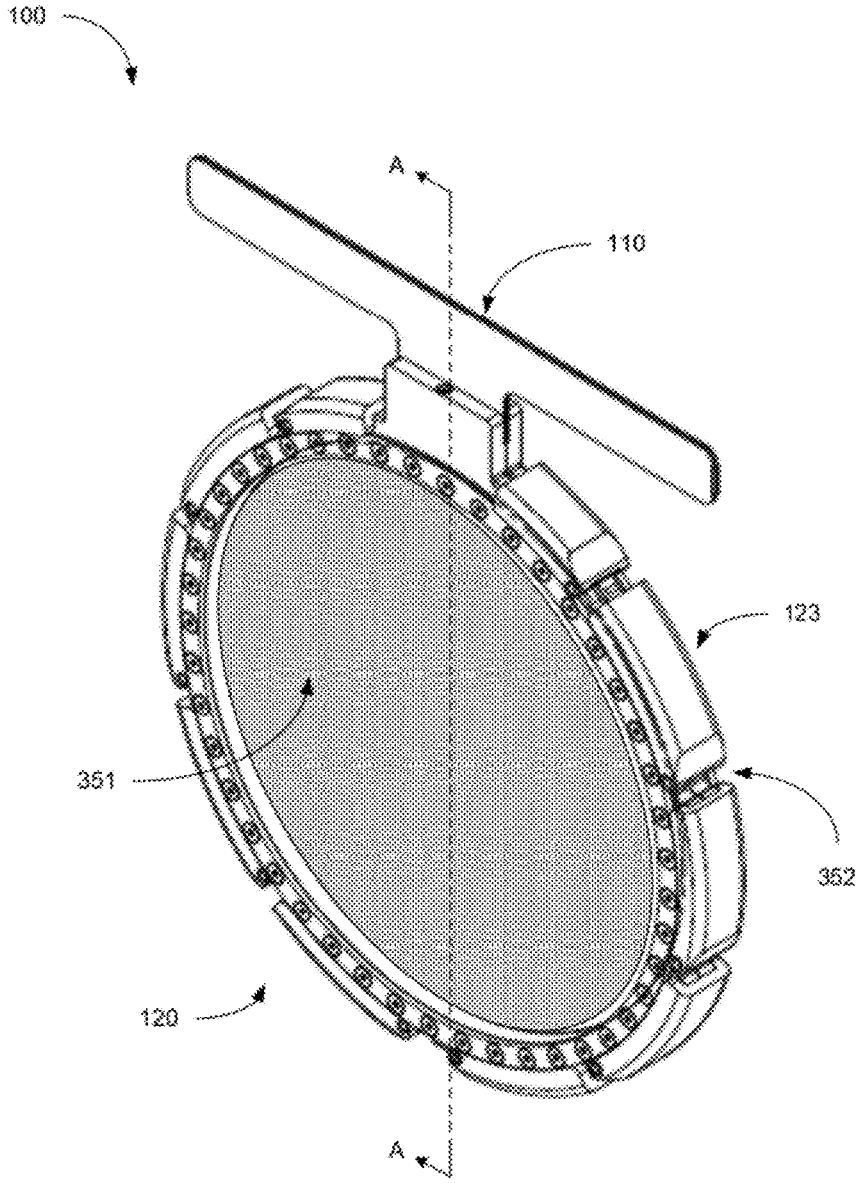
FIG. 3 is a diagram illustrating a carrier according to an embodiment.

FIG. 3 is a diagram illustrating a wafer carrier 100 according to an embodiment of the present invention. In this embodiment, wafers 351 and 352 are placed into non-conductive frame 120. When placed in non-conductive frame 120, wafers 351 and 352 may be oriented back-to-back, with the front side of each wafer facing out. In one embodiment, wafer 351 and 352 may contact each other on the back side when compressed between the pieces of non-conductive frame 120. The pieces of non-conductive frame 120 are secured together with clamp 123. Alternatively, an insert material may be added between wafers 351 and 352 during the process of compressing and clamping frame pieces 121 and 122 together and securing with clamp 123.

Figure 4:
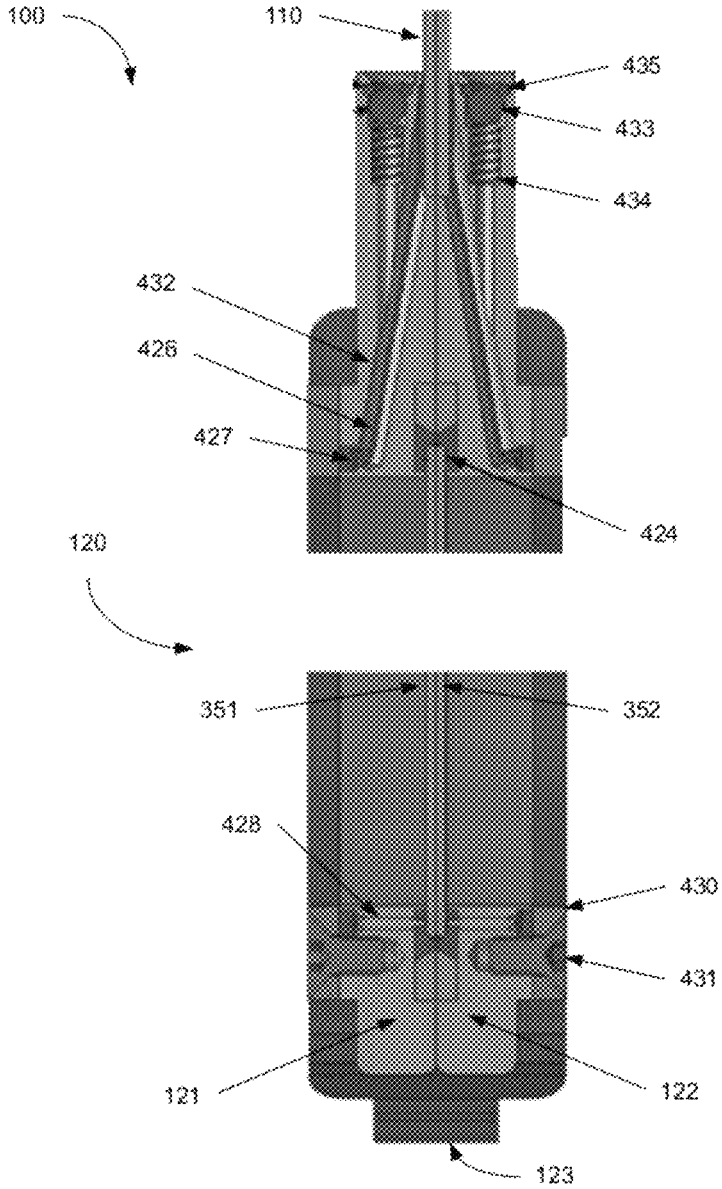
FIG. 4 is a cross section diagram illustrating a carrier according to an embodiment.

FIG. 4 is a cross-section diagram illustrating a wafer carrier 100 according to an embodiment of the present invention. The cross section A-A is taken from the view indicated by plane A-A shown in FIG. 3. The wafer carrier 100 includes a conductive flange 110 which serves to couple the wafer carrier 100 to a plating machine. Coupled to conductive flange 110 is non-conductive frame 120. In one embodiment non-conductive frame 120 includes two frame pieces 121 and 122. The pieces 121 and 122 of non-conductive frame 120 are secured together with one or more clamps 123. Clamp 123 may be connected to one of the frame pieces, such as non-conductive frame piece 122. Wafer carrier 100 holds two wafers 351 and 352 in place during a plating process, such as electroplating. The wafers 351 and 352 may be oriented back-to-back, so that the front side of each wafer is facing out.

Other than frame piece 122 having clamp 123 connected to it, non-conductive frame pieces 121 and 122 may be substantially identical in one embodiment. The various features of the non-conductive body 120 may be described with respect to either frame piece 121 or 122; however it should be understood that the description applies equally to both frame pieces. In alternative embodiments, there may be differences between frame pieces 121 and 122.

In one embodiment, each non-conductive frame piece includes a seal 424 in an area where the wafer 352 contacts the frame piece 122. Seal 424 may take the form of a ring that fits between the edge of wafer 352 around the interior circumference of frame piece 122. During electroplating various chemicals may be applied to the front side of the wafer 352. It would be undesirable to have these electroplating process chemicals contact the inner portions of the frame piece 122. The seal 424 prevents the electroplating process chemicals from leaking into the frame piece 122. In one embodiment seal 424 is made from chemically resistant rubber or rubber like materials such as Viton, however in other embodiments, some other material may be used.

In one embodiment, the wafer seal 424 is designed with features such that it will retain the wafer 352 within the frame piece 122 for the purposes of simplified loading and unloading of the wafer carrier and any other purpose when the wafer is retained in frame piece 122 prior to assembly with or after disassembly from the other frame piece 121.

One embodiment of the retaining feature is illustrated, and includes a flexible lip that is slightly smaller in diameter than the wafer to be retained. In operation, the wafer is pushed into the seal axially causing the flexible lip to deform and allowing the wafer to pass the lip, after which the lip returns to its original shape, and rests on the back surface of the wafer, retaining it. Removal of the wafer is accomplished by reversing the procedure. Pulling the wafer out of the seal will deform the lip, allowing the wafer to be removed, after which the lip will return to its original shape. Pushing and pulling forces are minimal during the process so as not to harm the wafer.

During the electroplating process, an electric potential is developed in the plating system where the wafers being plated are the cathode. In one embodiment, the electrical potential causes ions to flow from the anode to the cathode, which is the wafer in the wafer carrier 120. The current may flow from an electroplating solution through the wafer, through pogo pin 428, through electrical contact 427, through conductor 426, and out to ground through flange 110. In one embodiment, conductor 426 may be a copper wire connected between flange 110 and electrical contact 427, however, in other embodiments, some other conductor may be used. Electrical contact 427 may be a copper ring that extends around the circumference of piece 121. Electrical contact 427 may be embedded within frame piece 121. In other embodiments, some other conductive metal may be used to form electrical contact 427.

A connection is formed between electrical contact 427 and wafer 351 through one or more pogo pins 428. Pogo pin 428 is a device used to establish an electrical connection between a conductive surface on the wafer to be plated and the electrical contact 427. In one embodiment, pogo pin 428 takes the form of a slender cylinder containing a spring-loaded pin at least one end. Pogo pin 428 is securely press fit into frame pieces 121 and 122 enabling electrical contact between electrical contact 427 and wafer 351. The sharp spring-loaded points at the end of pogo pin 428 make secure electrical contact with wafer 351 and thereby connect them together. Pogo pin 428 may be plated in gold or some other conductive precious metal. There may be a plurality of pogo pins spaced around electrical contact 427 to contact the edge of wafer 351. In one embodiment, the plurality of pogo pins may be spaced evenly apart from one another.

Each of non-conductive frame pieces 121 and 122 includes a capture ring 430. Capture ring 430 extends around the circumference of frame piece 122. In one embodiment capture ring 430 is made from CPVC, however, in other embodiments, some other non-conductive material or material which is not subject to build-up or reduction during processing may be used. Capture ring 430 is held to frame piece 122 by a number of screws 431. The screws 431 may be appropriately tightened to apply sufficient pressure to electrical contact 427 to ensure a solid connection electrical contact 427, pogo pin 428 and wafer 352. In one embodiment, screws 431 may be made from non-conductive plastic, however, in other embodiments, some other material may be used such as material which is not subject to build-up or reduction during processing.

In one embodiment, each of non-conductive frame pieces 121 and 122 includes a system to test the integrity of the seals therein. Conductor 426 may be run from conductive flange 110 to electrical contact 427 through vacuum cavity 432. Vacuum cavity 432 may have an outlet secured by a stopper. In one embodiment, the stopper may include a titanium ball 433 pressed by a spring 434 against an o-ring 435. The ball 433 may be depressed in order to test the vacuum in vacuum cavity 426. If vacuum cavity 432 holds a vacuum for a predetermined length of time, it follows that seals are functioning properly. Titanium ball 433 seals off vacuum cavity 432 when not being tested.

In addition to the electrochemical deposition, the wafer carrier described herein may be used during other wet chemical processing steps. These processing steps may include for example, plating pattern resist strip, etching of the seed layer metal, or other processes. During electroplating, a template formed from a plating pattern resist, such as a photoresist, is applied to the surface of the wafer, covering a portion of the surface. The uncovered portion of the wafer surface is electroplated. In a subsequent processing step, the plating pattern resist is removed during plating pattern resist strip. A seed layer metal on the wafer, which may be formed from titanium-tungsten and copper, is removed through an etching process. Etchants are applied to the wafer to remove the exposed seed layer metal. In one embodiment, the wafer carrier may hold the wafers during these and other processes.

Although the operations of the methods herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

What is claimed is:

1. A carrier for performing wet chemical processing on a substrate using processing equipment, the carrier comprising:

a conductive flange to couple the carrier to the processing equipment;

a non-conductive frame coupled to the conductive flange, the non-conductive frame to hold a first substrate in place during the wet chemical processing, wherein the non-conductive frame comprises a first frame piece coupled to a second frame piece, and wherein the first frame piece and second frame piece are substantially identical; and a first electrical contact coupled to the conductive flange, the first electrical contact to apply an electrical potential to the first substrate.

2. The carrier of claim 1, wherein the non-conductive frame to hold a second substrate in place during the wet chemical processing, and further comprising a second electrical contact coupled to the conductive flange, the second electrical contact to apply the electrical potential to the second substrate.

3. The carrier of claim 2, wherein the first seal and the second seal each comprise a flexible lip to hold the first and second substrates in the first and second frame pieces while the first and second frame pieces are not secured together.

4. The carrier of claim 2, wherein the non-conductive frame comprises a vacuum cavity to enable testing to confirm that the first frame piece, the second frame piece, the first substrate and the second substrate are properly coupled.

5. The carrier of claim 4, wherein the first frame piece comprises a first capture ring to compress the first plurality of pogo pins into the first substrate and a second capture ring to compress the second plurality of pogo pins into the second substrate.

6. The carrier of claim 2, further comprising:

a first plurality of pogo pins coupled to the first electrical contact and a second plurality of pogo pins coupled to the second electrical contact, the first plurality of pogo pins to contact the first substrate and the second plurality of pogo pins to contact the second substrate.

7. The carrier of claim 2, wherein the non-conductive frame comprises a first seal in an area where the first substrate contacts the first frame piece and a second seal in an area where the second substrate contacts the second frame piece, the first seal and the second seal to prevent exposure of an interior of the non-conductive frame.

8. The carrier of claim 1, further comprising:

a plurality of clamps to secure the first frame piece and the second frame piece together.

9. The carrier of claim 1, wherein the wet chemical processing comprises one of electrochemical deposition, plating pattern resist strip, or etching of a seed metal layer.

10. The carrier of claim 1, wherein the processing equipment comprises in-line plating equipment.

11. The carrier of claim 1, wherein the processing equipment comprises batch, rack or flight bar style plating equipment.

12. A method comprising:

holding a first substrate in a carrier, the carrier comprising a first non-conductive frame piece coupled to a second non-conductive frame piece, wherein the first frame piece and second frame piece are substantially identical, and wherein the first substrate is held between the first non-conductive frame piece and the second non-conductive frame piece with a front side of the first substrate exposed through the first non-conductive frame piece; and coupling the carrier to wet chemical processing equipment.

13. The method of claim 12, further comprising:

holding a second substrate in the carrier, wherein the second substrate is held between the first non-conductive frame piece and the second non-conductive frame piece with a front side of the second substrate exposed through the second non-conductive frame piece.

14. The method of claim 13, wherein the carrier further comprises:

a conductive flange;

a first electrical contact coupled to the conductive flange and embedded within the first non-conductive frame piece; and a second electrical contact coupled to the conductive flange and embedded within the second non-conductive frame piece.

15. The method of claim 14, wherein coupling the carrier to the processing equipment comprises coupling the conductive flange to the processing equipment.

16. The method of claim 15, further comprising:

applying an electrical potential to the first substrate and the second substrate through the first electrical contact and the second electrical contact.

17. The method of claim 16, further comprising:

preventing exposure of an interior of the first non-conductive frame piece and an interior of the second non-conductive frame piece.

18. A system comprising:

wet chemical processing equipment;

means for performing wet chemical processing on a first substrate using the wet chemical processing equipment, the means for performing comprising a carrier comprising a first non-conductive frame piece coupled to a second non-conductive frame piece, wherein the first frame piece and second frame piece are substantially identical.

19. The system of claim 18, wherein the means for performing comprises:

means for holding the first substrate and a second substrate between the first non-conductive frame piece and the second non-conductive frame piece;

means for attaching the carrier to the processing equipment; and means for applying an electrical potential to the first and second substrates.

* * * * *